United States Patent [19]

Chaseling

[11] Patent Number: 4,729,196

[45] Date of Patent: Mar. 8, 1988

[54] APPARATUS FOR MACHINING RAIL BEARING SURFACES

[75] Inventor: Arthur W. Chaseling, Albany Creek, Australia

[73] Assignee: Winders, Barlow and Morrison Pty., Ltd., Brisbane, Australia

[21] Appl. No.: 907,627

[22] Filed: Sep. 15, 1986

[30] Foreign Application Priority Data

Sep. 17, 1985 [AU] Australia ..... PH02469

[51] Int. Cl.[4] ..... B24B 19/00

[52] U.S. Cl. ..... 51/241 S; 51/291

[58] Field of Search ..... 51/178, 241 LG, 241 R, 51/241 S, 241 B, 291

[56] References Cited

U.S. PATENT DOCUMENTS

| | | | |
|---|---|---|---|
| 1,562,558 | 11/1925 | Hobson | 51/241 LG |
| 2,132,861 | 10/1938 | Perazzoli | 51/241 S |
| 2,524,332 | 10/1950 | Sichel | 51/241 S |

FOREIGN PATENT DOCUMENTS

| | | | |
|---|---|---|---|
| 325165 | 2/1972 | U.S.S.R. | 51/241 LG |
| 585050 | 12/1977 | U.S.S.R. | 51/241 S |

*Primary Examiner*—Harold D. Whitehead

*Attorney, Agent, or Firm*—McAulay, Fields, Fisher, Goldstein & Nissen

[57] ABSTRACT

Machining apparatus (10) which can be mounted on the cage (15) of a slew bearing (12) to grind the bearing surface (23) of a rail section (13). The machining apparatus is provided with a grinding profile 30 which it may follow to perform the desired cut along the rail section (13).

16 Claims, 4 Drawing Figures

APPARATUS FOR MACHINING RAIL BEARING SURFACES

BACKGROUND OF THE INVENTION

This invention relates to methods of and apparatus for machining rail bearing surfaces.

This invention has particular but not exclusive application to in situ machining of upper and lower slew bearing rails and for illustrative purposes reference will be made hereinafter to the in situ machining of such rails. It is to be understood however that this invention could be utilized in other applications such as the machining of linear rails as well as circular rails.

DESCRIPTION OF THE PRIOR ART

Many earth moving machines with large slewing superstructures supported on a base structure utilize a slew bearing consisting of upper and lower circles or part circles of rails with bearing rollers therebetween. The bearing rollers are retained in spaced relationship around the rails by a cage assembly having interconnected inner and outer side plates between which the rollers extend. Generally the side plates are joined by pins passing through central bores in the rollers.

In such slew bearings failure of the bearing surface of the rollers or the rails may occur as a result of localised high contact stresses which may be due to lack of operative flatness in the rail circles. This may result from distortion of the supporting base structure or an uneven distribution of the applied load.

For example a typical dragline slew bearing may have a segmented top rail comprising a 120 degree front segment disposed symetrically beneath the boom and a 90 degree rear segment. It has been found that in such bearings the peak loads in the front segment occur at or adjacent the ends of the rails and these may be much greater than the load applied to the central portion of the rail.

In order to alleviate this problem which leads to premature failure of the rail ends, manufacturers frequently taper the end portions of the rails. This has the effect of shifting the load peaks inwardly towards the center of the rail. However unduly high load concentrations still occur. This can be alleviated to a large extent by forming a compound taper along the end portions of the rails. This is a difficult task since the rails are also tapered radially to provide accurate rolling motion between the rollers and rails. Such bearings also have extremely large physical dimensions.

At present corrective machining processes can only be performed on existing bearings by dismantling the rails and by transporting the rail segments to a suitable machine shop. This is expensive and results in an unduly long down time for the machine.

Other techniques are used to correct rail flatness as well as re-machining of the rail surfaces or the rail mounting pads. For example the rails may be removed and remounted on their mountings with a variable thickness grout interposed therebetween. However this in situ technique still requires dismantling of the slew bearing and thus it is time consuming and expensive and can be justified only in the case of severe flatness deviations all around the bearing.

SUMMARY OF THE INVENTION

The present invention aims to alleviate the above-mentioned disadvantages associated with the presently available methods of forming or correcting rail surface flatness or profiles and to provide a method of and means for machining rail bearing surfaces which will be reliable and efficient in use. Other objects and advantages of this invention will hereinafter become apparent.

With the foregoing and other objects in view, this invention in one aspect resides broadly in machining apparatus for machining the rail bearing surface of a rolling element bearing assembly, including: cutting apparatus; carriage means for supporting said cutting apparatus for operative movement along said rail bearing surface and guide means attachable to said bearing assembly for regulating the longitudinal rail surface profile to be cut by said cutting apparatus.

Preferably the cutting apparatus is a rotary cutter or a grinding wheel and said guide means is a guide track. The cutting apparatus may be supported on support means associated with a follower or movable along said guide rack whereby the longitudinal rail profile may be ground to the longitudinal profile of said guide track. Preferably the grinding wheel or rotary cutter is urged into operative cutting engagement with the rail by biassing means such as a spring assembly, counterweight or other pressurized means. The biassing means and the speed of rotation of the grinding wheel may be selectively adjustable if desired. They may be varied to provide fast removal of metal or fine surface finishing as required.

In a further aspect, this invention resides broadly in a method of machining a rail bearing surface including supporting machining apparatus on carriage means whereby said machining apparatus is movable along the rail in an operative machining attitude; providing guide means for regulating the form of cut to be performed by the machining apparatus along a rail section to be machined; actuating said machining apparatus and engaging said machining apparatus with said rail section until the desired cut is performed.

In a preferred form, the invention is adapted for machining a rail of a rolling element bearing and the method includes utilizing the rolling element cage as the carriage and providing grinding apparatus to machine the rail. The grinding apparatus may be supported between rollers of the bearing or in lieu of a roller thereof whereby the method may include in situ machining of a rail surface including removing a roller from its supports on the cage and supporting the machining apparatus by the cage in place of the removed roller.

BRIEF DESCRIPTION OF THE DRAWING

In order that this invention may be more readily understood and put into practical effect, reference will now be made to the accompanying drawings which illustrate preferred embodiments of the invention, wherein.

DESCRIPTION OF THE PREFERRED EMBODIMENTS

Figure 1:
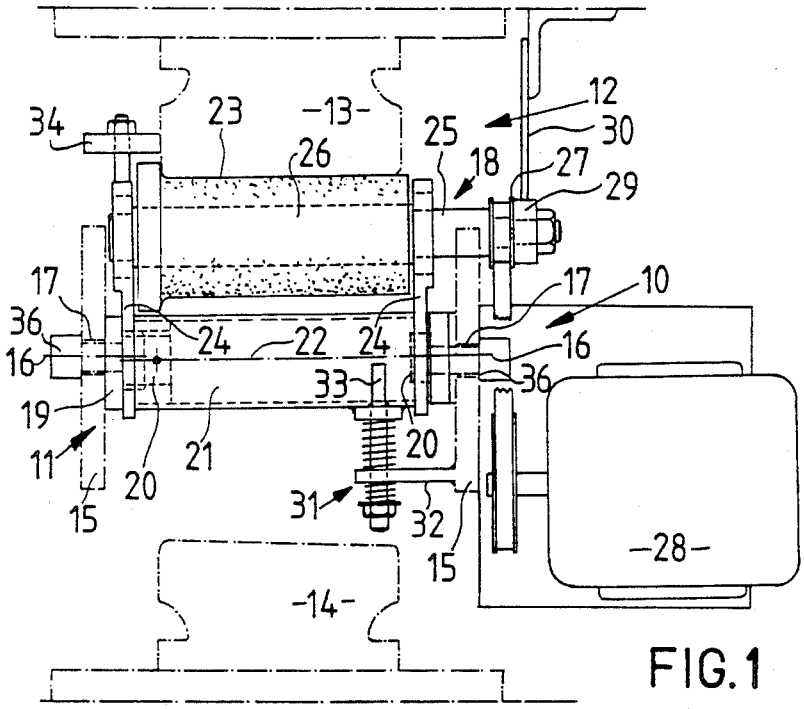
FIG. 1 is an end elevational view of one form of machining apparatus supported on the cage of a slew bearing.
Figure 2:
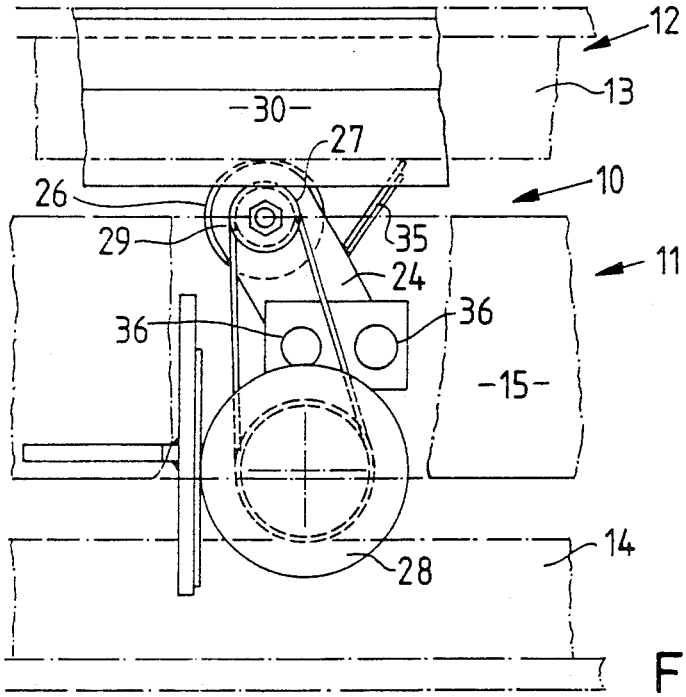
FIG. 2 is a side elevational view of the machining apparatus illustrated in FIG. 1.

As illustrated in FIGS. 1 and 2, the machining apparatus 10 is supported on the bearing cage assembly 11 of a slew bearing assembly 12 having tapered top and bottom rails 13 and 14 respectively and correspondingly tapered rollers. The rollers 9 are supported between the opposed side plates 15 of the cage assembly 11 for rotation about their respective rolling axes 16. In this embodiment one roller 9 of the slew bearing 12 is removed so that the machining apparatus 10 may be fitted to the cage assembly 11.

The machining apparatus 10 comprises a pivotable cradle 17 supported on a mounting bar 18 bolted through the respective spaced pairs of roller mounting apertures 19 in the opposed side plates 15. The mounting bar 18 provides pivot bearings 20 engageable with the hub 21 of the cradle 17 such that the pivot axis 22 of the cradle 17 is inclined to the roller axis 16 and parallel to the bearing face 23 of the rail being machined, in this instance the top rail 13. The cradle 17 has a pair of spaced arms 24 extending away from the hub 21. The outer ends of the arms 24 are provided with bearings for supporting the axle 25 of a rotary grinding wheel 26. The profile of the grinding wheel 26 is formed to suit the configuration of the rail 13.

The axle 25 on which the wheel 26 is supported extends inwardly beyond the inner side plate 15 to support a pulley 27 for a belt drive interconnecting the axle 25 to an electric motor 28 mounted on the adjacent side plate 15. It also supports a cam follower 29 engageable with a cam track or profile 30 mounted fixedly with respect to the rail 13. Spring biassing means 31 is mounted between a bracket 32 on the side plate 15 and a lever 33 extending from the hub 21. The spring 31 forces the wheel 25 pivotally upwards into engagement with the rail 13 and the cam follower 29 towards engagement with the cam profile 30. A locating roller 34 is supported on the outer arm 24 of the cradle assembly 11 to maintain correct radial alignment between the grinding wheel 26 and the rail 13 and a felt wiper 35 or the like is supported on the arms 24 to clean contaminating matter from the rail 13.

The cam profile 30 may have a flat cam surface or profile which may be disposed parallel to rail 13 so that the guiding wheel can be operated to correct flatness defects in the rail. Alternatively the profile surface may be arranged at an angle to the rail for cutting a taper in the rail. The cam profile 30 is preferably adjustably mounted so that the amount of metal to be ground from a surface can be selectively varied. The grinding apparatus 10 may be formed as a unit which is detachably securable to the side plates 15 by the roller mounting bolts 36 or it can be formed in separate units which may be individually fixed to the side plates 15.

In use a rail defect in a large slew bearing may be corrected or a selected rail profile may be formed in situ by removing a bearing roller 9 and mounting the machining apparatus 10 in its place with the associated profile 30 adjusted to provide the required cut. The cam profile can be of any desired form and it could be stepped or curved to provide a stepped or curved taper in a rail if desired. After the machining apparatus 10 and the cam profile have been correctly installed the motor 28 is activated and the slew bearing is rotated or reciprocated such that the grinding wheel 26 engages only a selected zone of the rail surface 23 and grinds the latter until sufficient material is removed to cause the cam follower to abut the cam profile at all points therealong to conform the profile of the rail surface 23 to the cam profile.

A segmented rail having a tapered end portion may be easily modified to a compound taper by supporting a straight edged cam profile at a suitable position to guide the grinding wheel 26 for a cut commencing partway along the original tapered portion and terminating at the rail surface inwardly of the original tapered surface portion.

Figure 3:
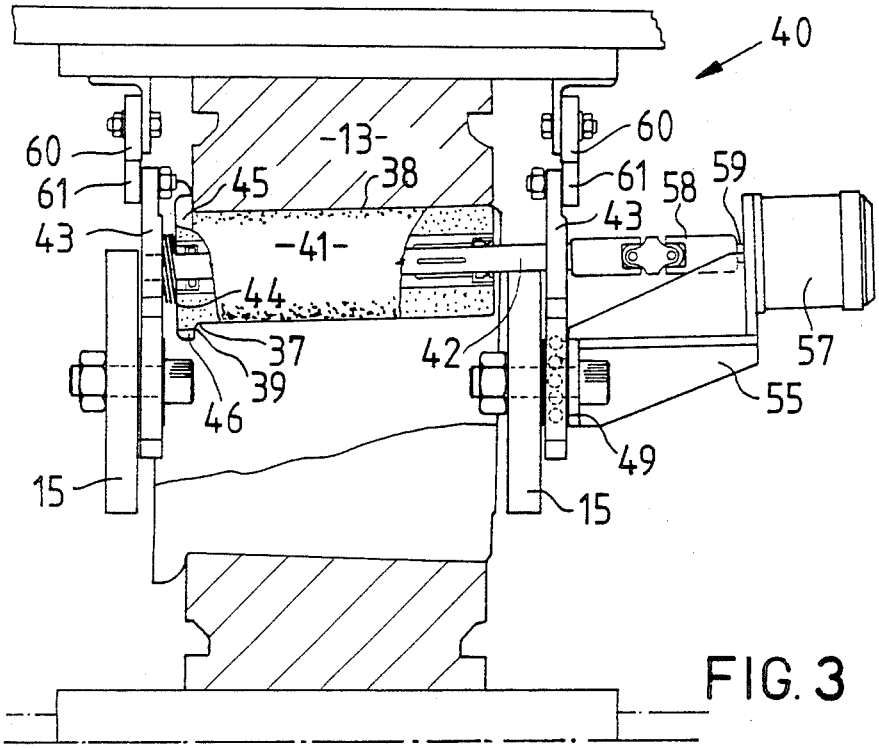
FIG. 3 is an end elevational view of an alternate form of machining apparatus.
Figure 4:
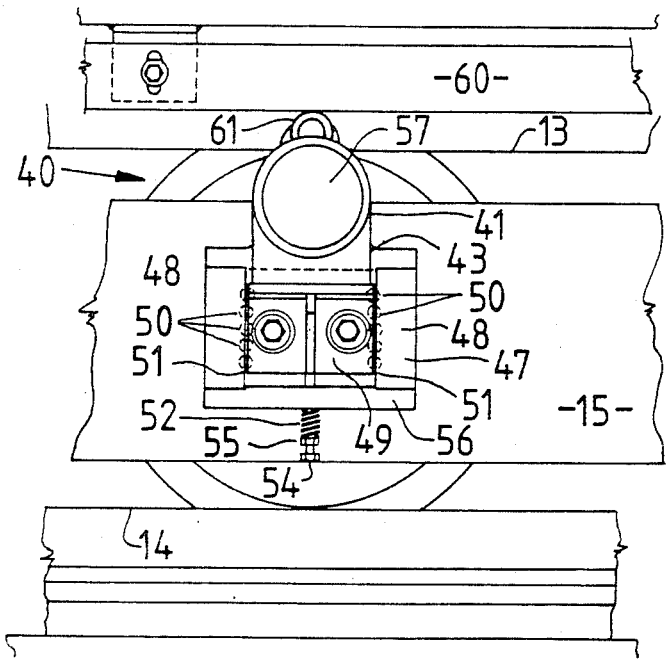
FIG. 4 is a side elevational view of the embodiment in FIG. 3.

The machining apparatus 40 illustrated in FIGS. 3 and 4 utilizes a grinding wheel 41 supported on a splined shaft 42 carried in separate bearing mounts 43 which are able to be fixed independently to the respective side plates 15 of the slew bearing cage. A compression spring 44 is mounted about the shaft 42 between the flanged end 45 of the wheel 41 (which is shown partly broken away) and the adjacent bearing mount 43 whereby the curved transition zone 37 between the cylindrical guiding wheel body 38 and its annular end face 39 is maintained in contact with the rail 13. A thrust collar 46 is formed about the periphery of the flanged end 45 to prevent undercutting of the side face of the rail 13.

Referring to FIG. 4 it will be seen that each bearing mount 43 is supported by a perimeter frame or yoke 47 supported for reciprocal movement in a direction at right angles to the bearing surface of the rail by a respective carrier 49. For this purpose each perimeter frame 47 is formed with grooved upright side members 48 in which caged balls 50 are supported for engagement with the correspondingly grooved side edges 51 of the carrier 49. This arrangement enables the respective perimeter frames to slide freely along its carrier 49. A compression spring 52 supported about the bolt 54 fixed to the carrier 49 and between the adjustable nut 55 and the lower perimeter frame member 56 urges the wheel 41 upwardly into engagement with the rail 13. The nut 55 may be adjusted to vary the grinding pressure. The grooves in the side members 48 and the carrier 49 in which the balls 51 are carried may be V-shaped grooves for ease of machining or they may be gothic arch type grooves or other shapes as required for maximising bearing surface.

One carrier 49 supports a mounting bracket 55 for an air motor 57 which is coupled to the splined shaft 42 by a universal jointed cardin drive shaft 58. This shaft 58 accommodates misalignment between the wheel supporting shaft 42 and the motor shaft 59. This occurs when the perimeter frames 47 slide relative to the carrier 49. This sliding movement is limited by the cam profiles 60 which co-operate with the guide wheels 61 mounted at the top of each bearing mount 43.

This embodiment operates in a similar manner to the previously described embodiment. However because the wheel 41 is guided for movement at right angles to the rail 13, the bearing pressure between the wheel and the rail 13 will be determined by the spring loading and will be substantially independent of the direction of travel of the apparatus 40 relative to the rail 13. Thus machining can be carried out during movement of the guiding wheel along the rail in either direction. Furthermore, the carriers 49 and the bearing mounts 43 can be fitted independently to their respective side plates 15. Prior to fitting the bearing mounts 43, the grinding wheel which may be supported temporarily in place until the shaft 42 is passed therethrough and through the bearing mounts 43. This greatly simplifies the attachment of the machining apparatus 40 to the slew bearing.

It will of course be realised that the above has been given only by way of illustrative example of the present invnetion and that all modifications and variations thereto as would be apparent to persons skilled in the art are deemed to fall within the broad scope and ambit of this invention as is defined in the appended claims.

I claim:

1. Machining apparatus for machining a bearing surface of a rail in a rolling element bearing assembly of the type having rolled elements caged between inner and outer side plates of a bearing cage, said machining apparatus including:

rail profile forming apparatus engageable with said bearing surface for machining said bearing surface;

a carriage assembly and connector means on said carriage assembly for connecting said carriage assembly to said bearing cage and for supporting said rail profile forming apparatus for movement with said bearing cage along said rail freely to and from said bearing surface;

biassing means for applying a selected surface cutting pressure to said rail profile forming apparatus;

profiled elongate guide means attachable to said rail adjacent to said bearing surface; and a follower attached to said rail profile forming apparatus and engageable with said profiled elongate guide means whereby movement of said rail profile forming apparatus towards said rail is limited by engagement of said follower with said guide means to machine the longitudinal bearing surface profile to conform to said profiled elongate guide means.

2. Machining apparatus according to claim 1, wherein said bearing assembly is a roller bearing and said rail forming apparatus is a grinding wheel having a cylindrical body portion and a flanged end portion which cooperate to form the selected transverse rail bearing surface profile.

3. Machining apparatus according to claim 2, wherein said carriage assembly includes a pair of support yokes between which said grinding wheel is rotatably supported, each said support yoke being supported by a slide for movement to and from said rail bearing surface, said slides each being independently connectible to a respective one of said inner and outer side plates of said bearing cage.

4. Machining apparatus according to claim 2, wherein said carriage assembly supports a driving motor for rotating said grinding wheel.

5. Machining apparatus according to claim 3, wherein said carriage assembly supports a driving motor for rotating said grinding wheel.

6. Machining apparatus according to claim 2, wherein said carriage assembly includes a pair of support yokes between which said rail profile forming apparatus is rotatably supported, each said support yoke being supported by a slide for movement to and from each rail bearing surface, said slides each being independently conectible to a respective one of said inner and outer side plates of said bearing cage.

7. Machining apparatus according to claim 6, wherein said carriage assembly supports a driving motor for rotating said rail profile forming apparatus.

8. Machining apparatus according to claim 1, wherein said carriage assembly supports a driving motor for rotating said rail profile forming apparatus.

9. Machining apparatus according to claim 8, wherein said bearing assembly is a roller bearing.

10. Machining apparatus according to claim 1, wherein said bearing assembly is a roller bearing.

11. Machining apparatus according to claim 1, wherein said rail forming apparatus is a grinding wheel having a cylindrical body portion and a flanged end portion which cooperates to form the selected transverse rail bearing surface profile.

12. Machining apparatus according to claim 6, wherein said rail forming apparatus is a grinding wheel having a cylindrical body portion and a flanged end portion which cooperates to form the selected transverse rail bearing surface profile.

13. Machining apparatus according to claim 7, wherein said rail forming apparatus is a grinding wheel having a cylindrical body portion and a flanged end portion which cooperates to form the selected transverse rail bearing surface profile.

14. A method of machining the bearing surface of a rail in a rolling element bearing assembly, including:

support machining apparatus on a carriage assembly;

connecting said carriage assembly to a bearing cage for carrying said machining apparatus along the rail in an operative machining attitude;

providing profiled elongate guide means for regulating the longitudinal profile performed by the machining apparatus along a rail section to be machined; and actuating said machining apparatus and engaging said machining apparatus with said rail section until the desired profile is formed.

15. A method according to claim 14, including:

supporting the carriage assembly by a roller cage, securing the carriage assembly to the roller cage, and arranging the profiled elongate guide means to enable said machining apparatus to remove projecting areas from said rail bearing surface and restore operative flatness thereto.

16. The method according to claim 14, wherein said carriage assembly may be supported by the roller cage of a roller bearing, the method further including securing the carriage assembly to the roller cage and arranging said guide means whereby said machining apparatus will remove projecting areas from said rail bearing surface and restore operative flatness thereto.

* * * * *